US006367170B1

(12) United States Patent
Williams

(10) Patent No.: US 6,367,170 B1
(45) Date of Patent: Apr. 9, 2002

(54) PLASTIC TOE CAP AND METHOD OF MAKING

(75) Inventor: Jason L. Williams, Erie, PA (US)

(73) Assignee: Darco Industries LLC, Granada Hills, CA (US)

( * ) Notice: Subject to any disclaimer, the term of this patent is extended or adjusted under 35 U.S.C. 154(b) by 0 days.

(21) Appl. No.: 09/739,461

(22) Filed: Dec. 18, 2000

(51) Int. Cl.[7] ..... A43C 13/14
(52) U.S. Cl. ..... 36/77 M; 36/77 R
(58) Field of Search ..... 36/77 R, 77 M

(56) References Cited

U.S. PATENT DOCUMENTS

| | | | | | |
|---|---|---|---|---|---|
| 4,638,574 | A | | 1/1987 | Roda | 36/7.2 |
| 4,839,971 | A | | 6/1989 | Reber | 36/77 R |
| 4,862,606 | A | | 9/1989 | Siskind et al. | 36/77 R |
| 5,210,963 | A | | 5/1993 | Harwood | 36/77 R |
| 5,331,751 | A | | 7/1994 | Harwood | 36/77 R |
| 5,529,826 | A | * | 6/1996 | Tailor et al. | 428/110 |
| 5,560,985 | A | | 10/1996 | Watanabe et al. | 428/251 |
| 5,666,745 | A | | 9/1997 | Harwood | 36/77 R |
| 5,667,857 | A | | 9/1997 | Watanabe et al. | 422/36.2 |
| 5,809,666 | A | | 9/1998 | Harwood | 36/77 R |
| 5,979,081 | A | * | 11/1999 | Vaz | 36/107 |
| 6,159,589 | A | * | 12/2000 | Isenberg et al. | 428/220 |

* cited by examiner

*Primary Examiner*—Ted Kavanaugh
(74) *Attorney, Agent, or Firm*—Richard K. Thomson

(57) ABSTRACT

A toe cap is a reinforcement member made of thermoset structural composite material with a tensile strength of 30,000 psi, a tensile modulus of $2.5\times10^6$ psi, a compression strength of 35,800 psi, a specific gravity of 1.85, and a Barcol hardness of 65. More preferably, the material has a tensile strength of at least 50,000 psi, a tensile modulus of at least $3.8\times10^6$ psi, a compression strength of at least 42,000 psi, a specific gravity of at least 1.90, and a Barcol hardness of at least 70. A suitable family of materials is a thermoset vinyl ester based sheet molding compound reinforced with glass fiber and/or carbon fiber. The sheet molding compound has fiber content of about 63% and a typical fiber length of one inch. The maximum wall thickness of the upper portion of the toe cap is in the range of between 0.100 inch and 0.250 inch.

11 Claims, 4 Drawing Sheets

PLASTIC TOE CAP AND METHOD OF MAKING

BACKGROUND AND SUMMARY OF THE INVENTION

The present invention is directed to a toe cap for reinforcing safety shoes, boots and the like. More particularly, the present invention is directed to a toe cap having increased tensile and compressive strength as well as improved impact resistance.

Originally, toe caps were made of metals such as steel. These caps necessarily made the shoes in which the were used heavy to wear producing increased fatigue in the wearer. When subjected to high compressive loads, steel toe caps would be permanently deformed and, in addition to possibly aggravating an injury to the wearer's foot by complicating shoe removal, the toe cap and, hence, the safety shoe, would be essentially damaged to the point of needing replacement. In addition, steel toe caps are electrically and thermally conductive making them unsuitable for certain applications. Lastly, steel is magnetically interactive rendering shoes equipped with steel toe caps unsuitable for uses including certain military applications, and the like.

More recently, toe caps have been made from various plastic materials, typically fiber reinforced thermoplastic injection molding compounds. Any reinforced shoe must pass a rigorous set of tests established by the American National Standards Institute (ANSI), currently enumerated in ANSI Z41-1999, as well as a variety of other international tests for shoes/boots to be sold into those markets. Very few plastics are tough enough to pass muster with all of these standards. Frequently, because of material limitations, the thickness of the toe cap must be increased to provide the required tensile and compressive strengths and the necessary impact resistance. This increased thickness increases weight and the increased size may necessitate enlargement of the shoe envelope if the increased wall thickness takes up too much room in the shoe.

It is an object of the present invention to provide a toe cap which satisfies the compression and impact tests of the ANSI and standards of other foreign countries with a single comparatively thin design. The toe cap of the present invention is a reinforcement member having a generally C-shaped lateral cross section, said reinforcement member being made of thermoset structural composite material with a tensile strength of at least 30,000 psi, a tensile modulus of at least $2.5\times10^6$ psi, a compression strength of at least 35,800 psi, a specific gravity of at least 1.85, and a Barcol hardness of at least 65. More preferably, the toe cap is made of a material having a tensile strength of at least 50,000 psi, a tensile modulus of at least $3.8\times10^6$ psi, a compression strength of at least 42,000 psi, a specific gravity of at least 1.90, and a Barcol hardness of at least 70. A suitable family of materials is a thermoset vinyl ester based sheet molding compound reinforced with glass fiber and/or carbon fiber. The sheet molding compound has fiber content of about 63% and a typical fiber length in the range between ½ and two inches. The maximum wall thickness of the upper portion of the toe cap, including the top portion and the side walls, is in the range of between 0.100 inch and 0.250 inch. With a slight thickening of the wall adjacent the inner edge, the toe cap of the present invention is able to pass the impact testing and to be in compliance with all necessary standards without unduly increasing the weight or the envelope required to house the toe cap.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
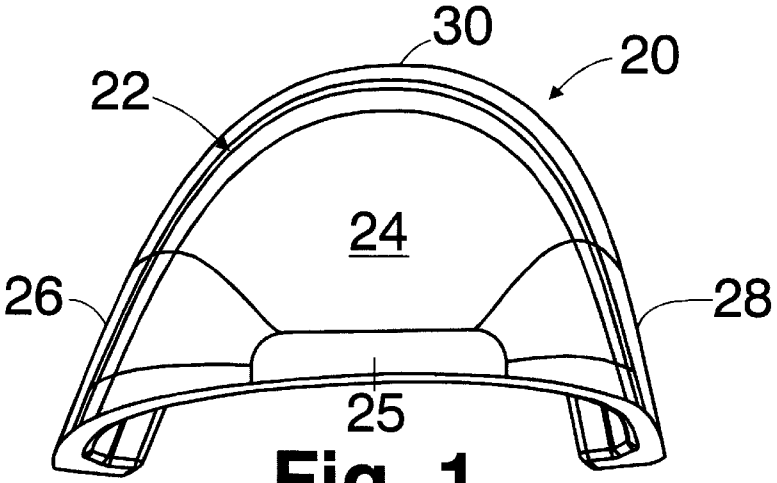
FIG. 1 is a top perspective view of a first embodiment of the toe cap of the present invention.
Figure 2:
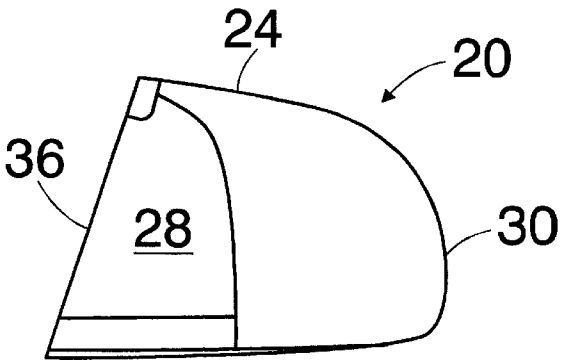
FIG. 2 is a side view of said first embodiment.
Figure 3:
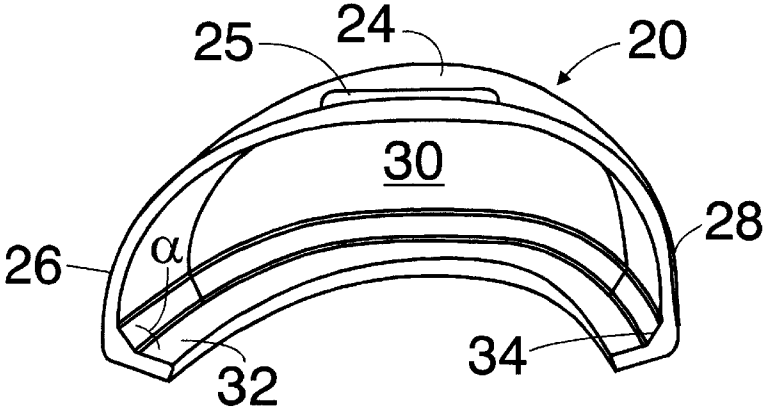
FIG. 3 is a perspective view from the back side of said first embodiment.
Figure 4:
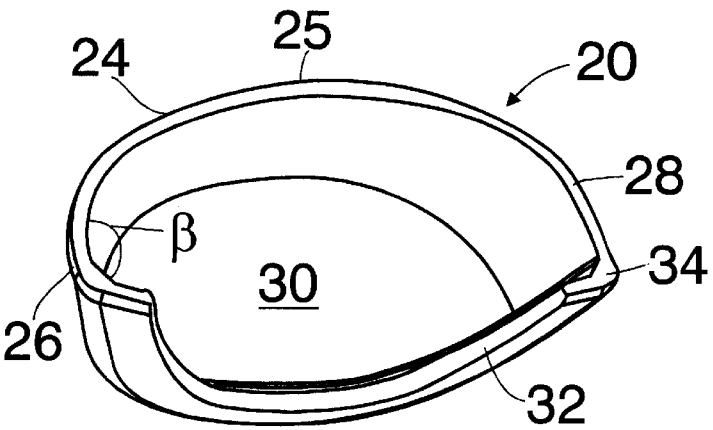
FIG. 4 is a second back perspective view of said first embodiment taken from a different angle.

The toe cap of the present invention is shown generally in FIGS. 1–4 generally at 20. Toe cap 20 is generally C-shaped in lateral cross section having a upper portion 22 which includes top surface 24 and side walls 26 and 28, and front wall 30. Walls 26, 28, 30 are connected to base 32 by chamfer 34. Chamfer 34 forms an angle $\alpha$ of between 120° and 150° with base 32 and a complementary angle $\beta$ of between 150° and 120°. Most preferably, $\alpha$ and $\beta$ are each equal to 135°. The walls 24, 26, 28, 30 of upper portion 22 preferably have a maximum thickness in the range of between 0.062 inch and 0.250 inch. The chamfer 34 is preferably has an increased maximum thickness to provide additional strength at the transition between the substantially vertical walls 26, 28, 30 and generally horizontal base 32. Trailing edge 36 preferably tapers outwardly from top surface 24 to base 32 (FIG. 2). Atop portion 25 (FIG. 1) is thickened by as much as 0.050 inch in some regions, the inside radius being maintained with a thickening occurring primarily in the region 25 and being tapered outwardly across top surface 24 into side portions 26 and 28. This thickened region 25 enhances load distribution and enables toe cap 20 to withstand the required impact and compression testing. The maximum thickness outside region 25 will typically not exceed 0.200 inch.

The toe cap 20 of the present invention is preferably made of a thermoset structural composite having a tensile strength of at least 30,000 psi, a tensile modulus of at least $2.5\times10^6$ psi, a compression strength of at least 35,800 psi, a specific gravity of at least 1.85, and a Barcol hardness of at least 65. More preferably, the toe cap 20 is made of a material which has a tensile strength of at least 50,000 psi, a tensile modulus of at least $3.8\times10^6$ psi, a compression strength of at least 42,000 psi, a specific gravity of at least 1.90 and a Barcol hardness of at least 70. Materials which have the desired properties include vinyl ester based sheet molding compounds reinforced with glass fibers, the compound having 63% by weight glass fibers of lengths in the range between about ½ inch and two inches. A family of vinyl ester based composites is identified as QC 8000 series available from Quantum Composites of Midland Mich., with a specific preferred material identified as QC 8800.

Figure 5:
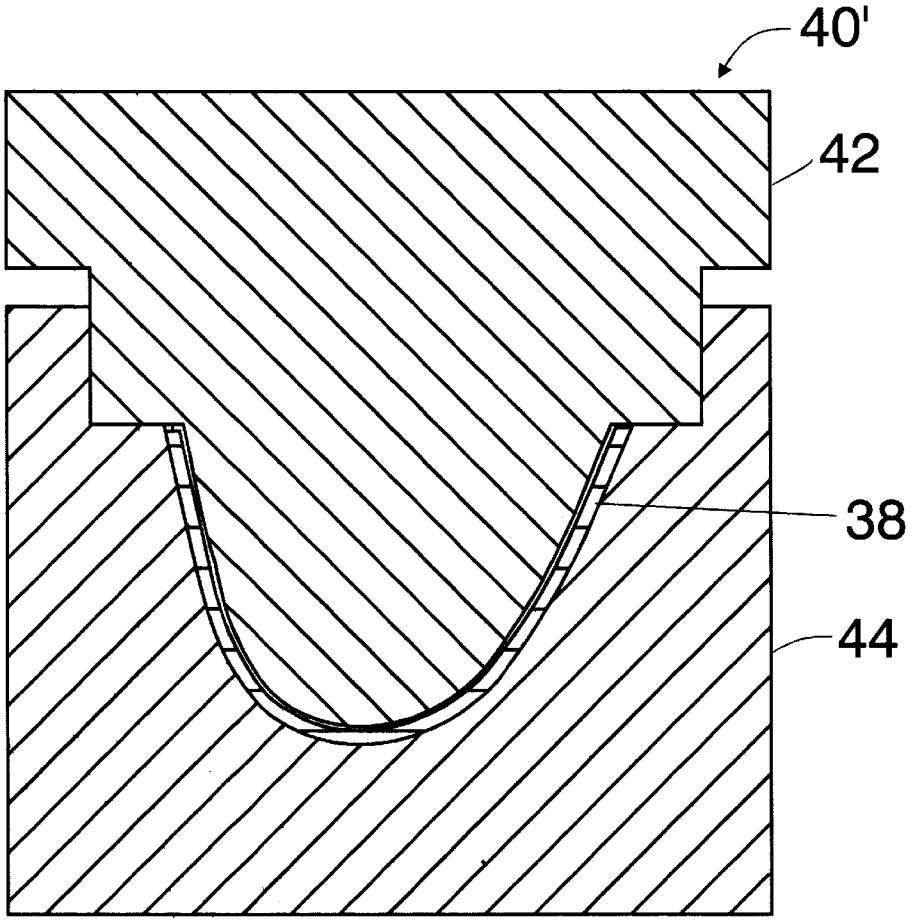
FIG. 5 is a cross-sectional front view of a single mold for manufacturing toe caps of the present invention.

FIG. 5 depicts a first shaping mold 40 useful in making the toe cap of the present invention. Mold 40 is a single cavity mold. The process of making toe cap 20 comprises cutting a swatch 38 of fiber reinforced, vinyl ester based sheet molding compound to a predetermined size which is generally slightly larger than the longitudinal and lateral. The swatch is then inserted into shaping mold which has first male half 42 and second female half 44. The mold halves 42 and 44 define a desired shape of the toe cap 20. The next step in the method of making toe cap 20 involves compressing the swatch to a pressure between 200 psi and 1000 psi in said shaping mold producing a maximum thickness in an upper portion of said toe cap which falls in the range of between 0.062 inch and 0.250 inch. The swatch 38 is cured in the mold at a temperature between 240° and 320° F. for a period of between 1 and 4 minutes. The shaped toe cap 20 is then ejected from the mold 40. A second mold (not shown) having a cross section which is a mirror image of that shown in FIG. 5 is used to produce a right toe cap 20 to complete the pair.

Figure 6A:
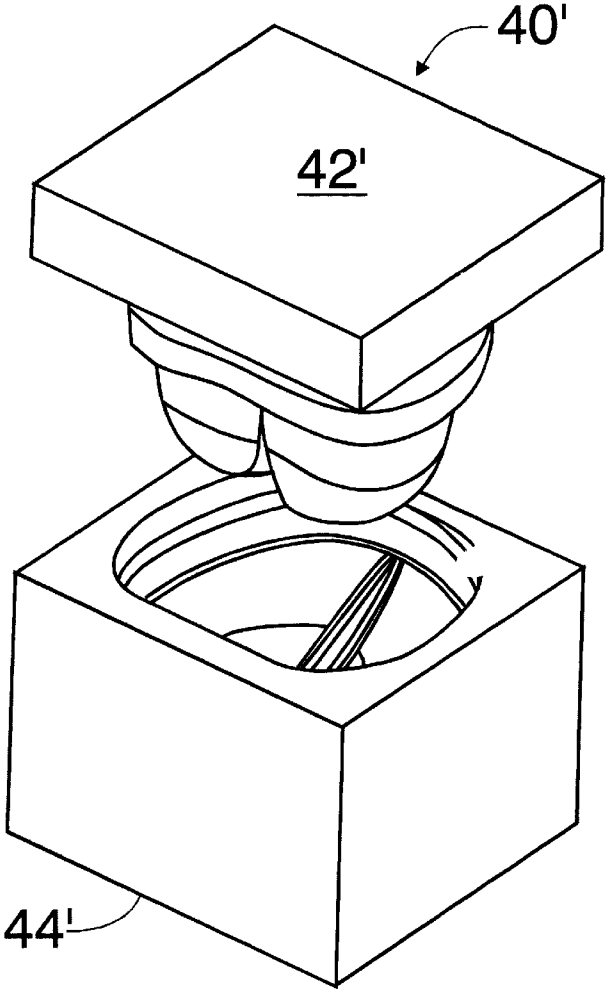
FIG. 6*a* is atop perspective view of a double mold for making pairs of toe caps of the present invention.
Figure 6B:
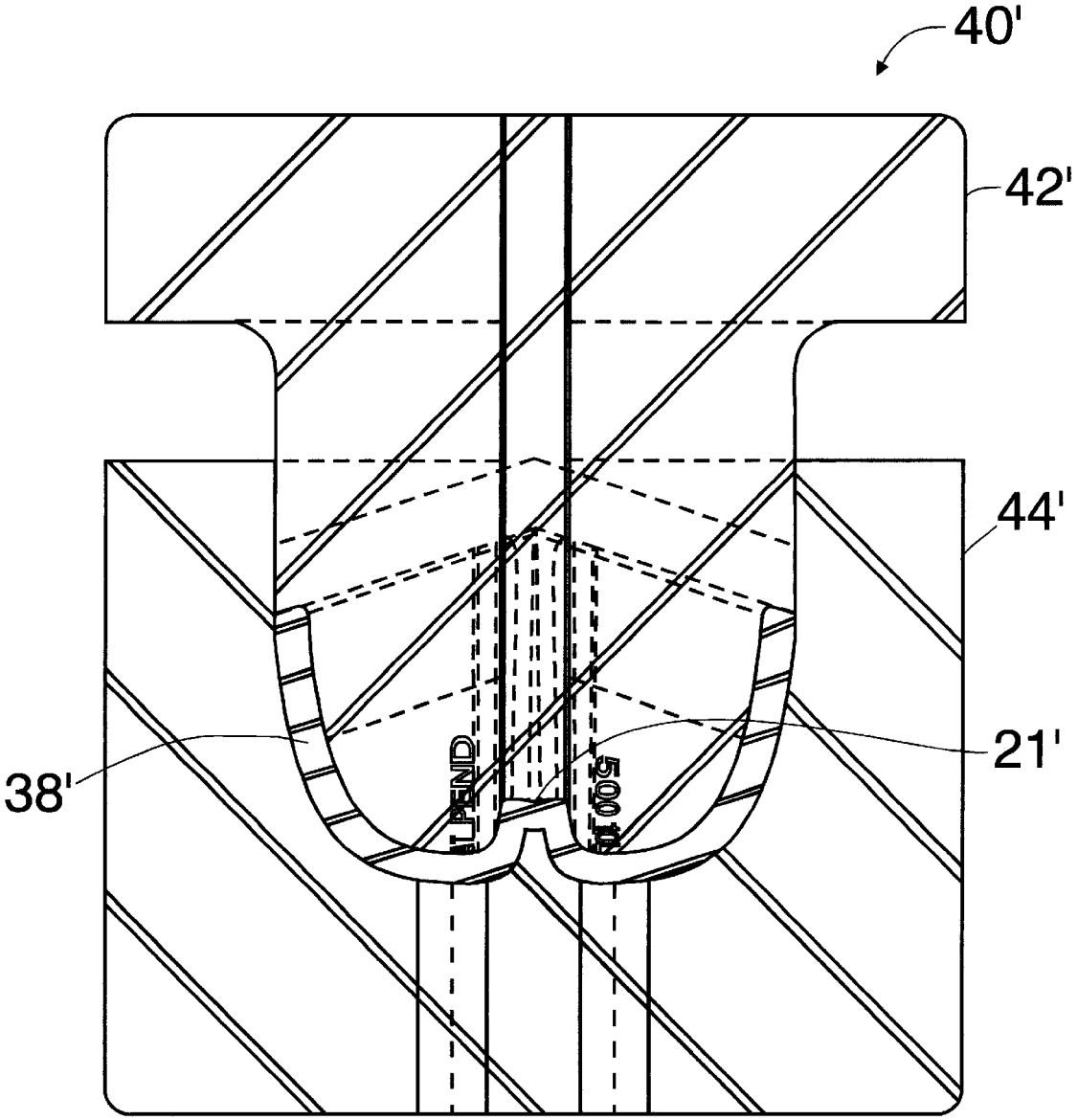
FIG. 6*b* is a cross-sectional front view of the double mold shown in FIG. 6*a;*
Figure 7B:
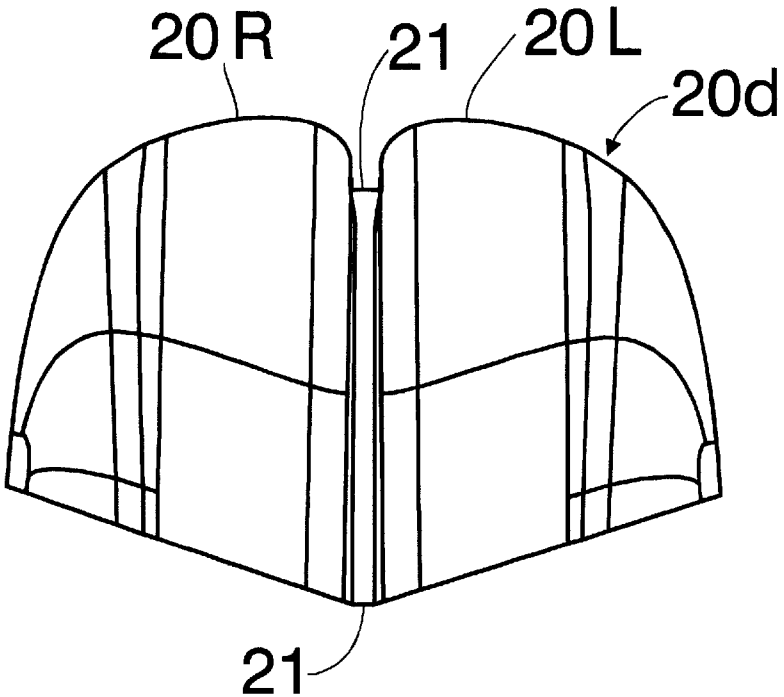
FIG. 7*b* is a cross-sectional front view of the-double molded toe cap shown in FIG. 7*a* as seen along line 7*b*—7*b*.
Figure 7A:
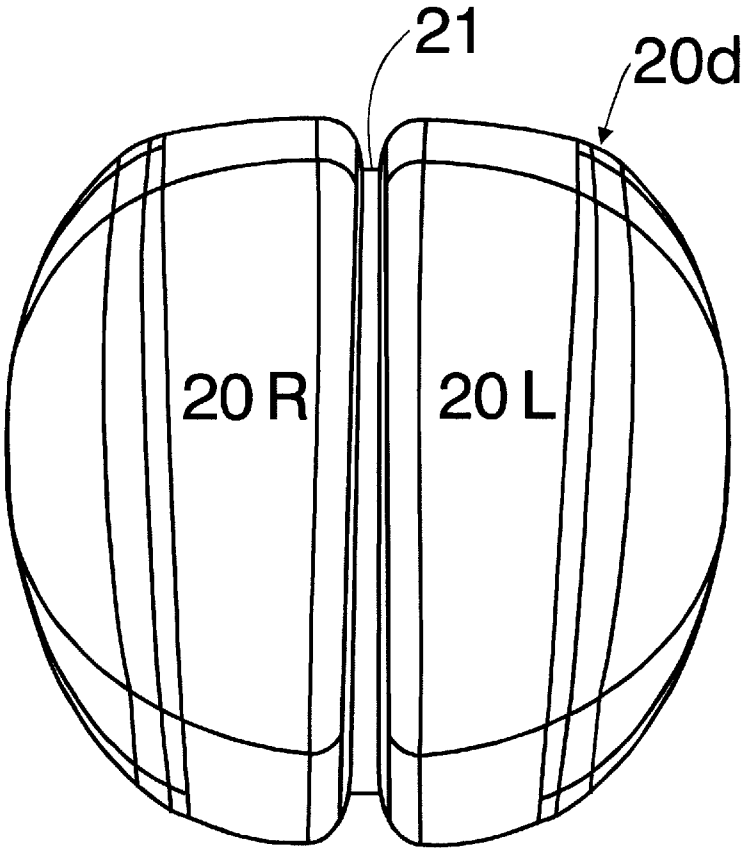
FIG. 7*a* is a top view of a molded double toe cap made in accordance with the method of the present invention.

FIGS. 6*a* and 6*b* show a second mold 40' which simultaneously forms a left toe cap 20L and a right toe cap 20R (FIGS. 7*a* and 7*b*). A swatch 38' which is more than twice the dimensions of a single toe cap 20 is inserted into female mold half 44' and male mold half 42' is lowered into female mold half 44' and the process defined in conjunction with molding a single toe cap 20 as described in conjunction with FIG. 5 above is carried out. Ejection pins (not shown) are inserted through apertures 45 to remove the double toe cap 20*d* from female mold half 44'. Once the double toe cap 20*d* is ejected from mold 40' (FIGS. 7*a* and 7*b*), right toe cap 20R and left toe cap 20L are separated by cutting through interconnecting membrane 21 that has a width of a single blade thickness.

The toe cap 20 of the present invention has improved tensile strength, compressive strength and impact resistance as compared to other plastic toe caps. In addition, the toe cap 20 does not suffer from the deficiencies associated with metal toe caps including permanent deformation, electrical conductivity and magnetic interaction. The toe cap 20 of the present invention has successfully passed the compression and impact tests of the ANSI and standards of other foreign countries.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A toe cap for reinforcement of shoes, boots and the like, comprising:

a reinforcement member having a generally C-shaped cross section, said reinforcement member being made of thermoset structural composite material with a tensile strength of at least 30,000 psi, a tensile modulus of at least $2.5\times10^6$ psi, a specific gravity of at least 1.85, and a Barcol hardness of at least 65.

2. The toe cap of claim 1 wherein said material has a compression strength of at least 35,800 psi.

3. The toe cap of claim 1 wherein said reinforcement member has a tensile strength of at least 50,000 psi, a tensile modulus of at least $3.8\times10^6$ psi, a specific gravity of at least 1.90 and a Barcol hardness of at least 70.

4. The toe cap of claim 3 wherein said material has a compression strength of at least 42,000 psi.

5. The toe cap of claim 1 wherein said generally C-shaped reinforcement member comprises a) an upper portion including a top surface and a generally vertical wall portion and, b) a substantially horizontal base.

6. The toe cap of claim 5 wherein said generally vertical wall portion is interconnected to said substantially horizontal base by a chamfer.

7. The toe cap of claim 6 wherein said chamfer forms an angle with said base in a range of between 120° and 150°.

8. The toe cap of claim 7 wherein said chamfer forms an angle of generally 135° with said base.

9. The toe cap of claim 5 wherein said upper portion has a maximum thickness which falls in the range of between 0.100 inch and 0.250 inch.

10. The toe cap of claim 9 wherein said upper portion has a thickened region across an instep which is as much as 0.050 inch thicker than other portions of said toe cap.

11. The toe cap of claim 1 wherein said toe cap is made of a fiber reinforced, vinyl ester based sheet molding compound.

* * * * *